US008213818B2

(12) United States Patent
Mori

(10) Patent No.: US 8,213,818 B2
(45) Date of Patent: Jul. 3, 2012

(54) TEMPERATURE CONTROL APPARATUS, ELECTROPHOTOGRAPHIC APPARATUS, AND TEMPERATURE CONTROL METHOD FOR HEATING ELEMENT

(75) Inventor: Shinya Mori, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 133 days.

(21) Appl. No.: 12/719,627

(22) Filed: Mar. 8, 2010

(65) Prior Publication Data

US 2010/0239299 A1 Sep. 23, 2010

Related U.S. Application Data

(60) Provisional application No. 61/160,974, filed on Mar. 17, 2009.

(51) Int. Cl.
*G03G 15/20* (2006.01)

(52) U.S. Cl. ..... 399/69; 219/216; 399/70; 399/88

(58) Field of Classification Search ..... 399/69, 399/70, 37, 88, 82; 219/216, 494
See application file for complete search history.

(56) References Cited

U.S. PATENT DOCUMENTS

| | | | | |
|---|---|---|---|---|
| 7,593,661 | B2 * | 9/2009 | Watanabe et al. | 399/88 |
| 2007/0014586 | A1 * | 1/2007 | Kobayashi | 399/70 |
| 2009/0129808 | A1 * | 5/2009 | Kamei | 399/88 |

FOREIGN PATENT DOCUMENTS

| | | | |
|---|---|---|---|
| JP | 63-296082 | A | 12/1988 |
| JP | 3-221984 | A | 9/1991 |
| JP | 3538278 | B2 | 11/1997 |

* cited by examiner

*Primary Examiner* — Sophia S Chen
(74) *Attorney, Agent, or Firm* — Patterson & Sheridan, LLP

(57) ABSTRACT

A temperature control apparatus includes a temperature sensor which detects a temperature of a heating element, a controller for controlling heat generation of the heating element in accordance with a detected temperature by the temperature sensor, and a monitoring circuit which monitors the detected temperature, and stops operation of the controller in a predetermined stop period defined on the basis of the detected temperature when a predetermined operation mode of plural operation modes is set.

9 Claims, 10 Drawing Sheets

-- Prior Art --

TEMPERATURE CONTROL APPARATUS, ELECTROPHOTOGRAPHIC APPARATUS, AND TEMPERATURE CONTROL METHOD FOR HEATING ELEMENT

CROSS-REFERENCE TO RELATED APPLICATION

This application is based upon and claims the benefit of priority from: U.S. Provisional Application No. 61/160,974 filed on Mar. 17, 2009, the entire contents of each of which are incorporated herein by reference.

TECHNICAL FIELD

A disclosed embodiment relates to a technique of controlling the temperature of a heating element such as a fixing roller in an electrophotographic apparatus.

BACKGROUND

Conventionally, various techniques for reducing power consumption in an electrophotographic apparatus are proposed.

In the techniques of these kinds, generally, during a period when there is no need to perform printing, the temperature of a fixing roller is maintained to a lower temperature than the temperature required for printing.

This maintenance of temperature is realized by monitoring the temperature of the fixing roller and performing control to heat the fixing roller intermittently with a controller. Therefore, the controller needs to operate constantly and there is power consumption by the controller.

SUMMARY

According to a first aspect, a temperature control apparatus includes: a temperature sensor which detects a temperature of a heating element; a controller for controlling heat generation of the heating element in accordance with a detected temperature by the temperature sensor; and a monitoring circuit which monitors the detected temperature, and stops operation of the controller in a predetermined stop period defined on the basis of the detected temperature when a predetermined operation mode of plural operation modes is set.

According to a second aspect, an electrophotographic apparatus includes: an image forming unit which, after a toner image is formed on a printing medium, melts and fixes the toner image to the printing medium with heating by a heating element; a temperature sensor which detects a temperature of the heating element; a controller for controlling heat generation of the heating element in accordance with a detected temperature by the temperature sensor; and a monitoring circuit which monitors the detected temperature, and stops operation of the controller in a predetermined stop period defined on the basis of the detected temperature when a predetermined operation mode of plural operation modes is set.

According to a third aspect, a temperature control method for a heating element includes: detecting a temperature of a heating element by a temperature sensor; controlling, by a controller, heat generation of the heating element in accordance with a detected temperature by the temperature sensor; and monitoring the detected temperature by a monitoring circuit and stopping operation of the controller in a predetermined stop period defined on the basis of the detected temperature when a predetermined operation mode of plural operation modes is set.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

Hereinafter, an embodiment will be described with reference to the drawings.

Figure 1:
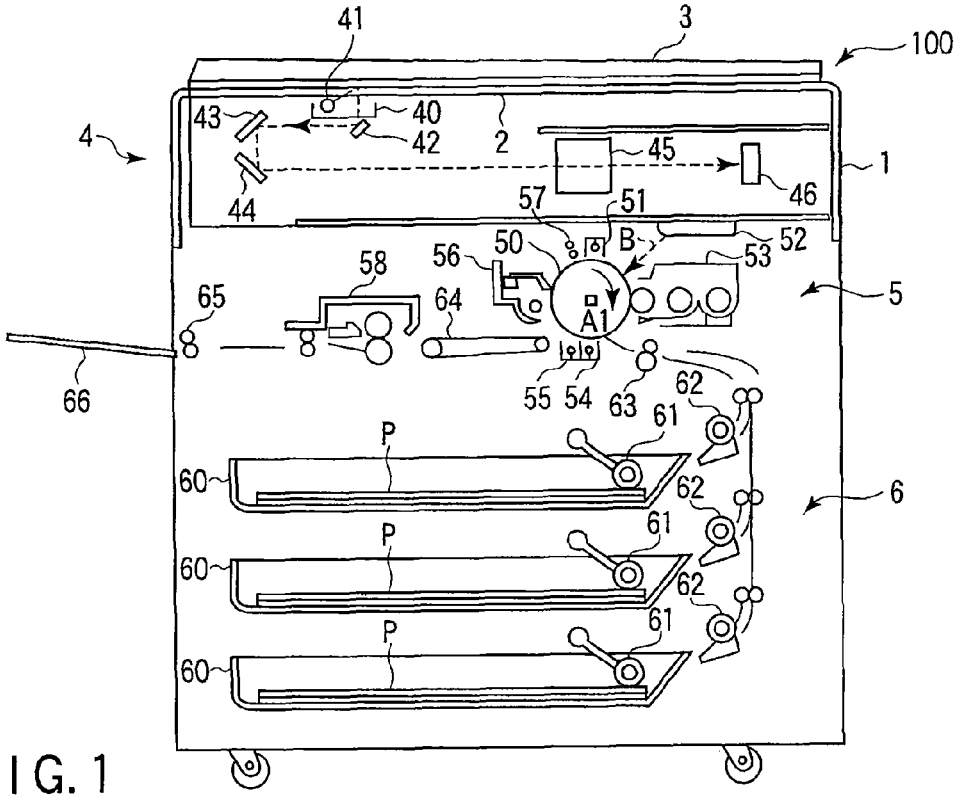
FIG. 1 shows the structure of an multi-function peripheral (MFP) according to an embodiment.

FIG. 1 shows the structure of an multi-function peripheral (MFP) 100 according to this embodiment.

The MFP 100 has a casing 1, an original table 2, a platen cover 3, a scanning unit 4, a printer engine 5, and a feeding unit 6.

The casing 1 is formed by having plural components assembled in a box-shape. The original table 2 is provided at the top part of the casing 1 in order to place an original as a scanning target. The original table 2 is, for example, a transparent glass board. The platen cover 3 is supported on the top part of the casing 1 in a manner that the platen cover 3 can freely open and close. In the closed state, the platen cover 3 covers the original table 2.

The scanning unit 4 is provided below the original table 2 in the casing 1. The scanning unit 4 scans the original placed on the original table 2. The scanning unit 4 includes a carriage 40, an exposure lamp 41, reflection mirrors 42, 43 and 44, a variable-magnification lens block 45, and a CCD (charge coupled device) 46.

The carriage 40 is supported on the bottom side of the original table 2 in a manner that the carriage 40 can be reciprocated along the original table 2. The carriage 40 holds the exposure lamp 41 and the reflection mirror 42. The exposure lamp 41 exposes the original placed on the original table 2 to light. By this exposure, a reflected light image generated on the original is projected to the CCD 46 via the reflection mirrors 42, 43 and 44 and the variable-magnification lens block 45. The CCD 46 converts the projected reflected light image into an image signal representing the luminance level of each of its plural pixels. The carriage 40 is reciprocated along the original table 2 by a moving mechanism, not shown.

The printer engine 5 includes a photoconductive drum 50, a charging unit 51, a laser unit 52, a developing unit 53, a transfer unit 54, a separation unit 55, a cleaner 56, a neutralizing unit 57, and a fixing unit 58.

The photoconductive drum 50 includes a metal drum made of a conductive material with its surface coated with a photoconductive-electrically conductive material to form a photoconductive layer. The photoconductive drum 50 is supported rotatably about its axis as the rotation axis. The photoconductive drum 50 is rotated in the direction of arrow A1 in FIG. 1 by a rotation mechanism, not shown. The charging unit 51, the laser unit 52, the developing unit 53, the transfer unit 54, the separation unit 55, the cleaner 56 and the neutralizing unit 57 are sequentially arranged around the photoconductive drum 50 and along the curved surface of the photoconductive drum 50.

The charging unit 51 uniformly charges the curved surface of the photoconductive drum 50 (hereinafter referred to as drum surface) with electric charges of a predetermined potential.

The laser unit 52 casts a laser beam B to the drum surface. The laser unit 52 changes the intensity of the laser beam B in accordance with an image signal outputted from the CCD 46. By doing so, the laser unit 52 forms, on the drum surface, an electrostatic latent image corresponding to the image represented by the image signal.

The developing unit 53 brings a charged toner closely to the drum surface and thus develops the electrostatic latent image by utilizing electrostatic adsorption of the toner to the drum surface.

The transfer unit 54 transfers the toner image formed on the drum surface by the development, to a printing medium P. The printing medium P is inserted between the photoconductive drum 50 and the transfer unit 54 by the feeding unit 6.

The separation unit 55 separates the printing medium P that is electrostatically adsorbed to the photoconductive drum 50, from the photoconductive drum 50.

The cleaner 56 removes the toner that remains on the drum surface without being transferred to the printing medium P, from the drum surface.

The neutralizing unit 57 removes electric charges from the drum surface.

The fixing unit 58 is arranged closely to the photoconductive drum 50. The printing medium P separated from the photoconductive drum 50 by the separation unit 55 is sent into the fixing unit 58. The fixing unit 58 melts and fixes, to the printing medium P, the toner image transferred to the printing medium P.

The feeding unit 6 includes plural cassettes 60, plural pickup rollers 61, plural separation units 62, a registration roller 63, a feeding belt 64, a paper eject roller 65, and a paper eject tray 66.

Each of the plural cassettes 60 is arranged in the lower part within the casing 1. Each of the plural cassettes 60 can house multiple printing mediums P. The printing mediums P housed in the plural cassettes 60 may be different from each other or the same in size, material, color and so on.

The plural pickup rollers 61 and the plural separation units 62 correspond to the plural cassettes 60, respectively. The pickup roller 61 and the separation unit 62 pick up one of the printing mediums P housed in the corresponding cassette 60 and send the printing medium P to the registration roller 63.

The registration roller 63 sends the printing medium P between the photoconductive drum 50 and the transfer unit 54 in timing in consideration of the timing when the toner image formed on the drum surface reaches the transfer position where transfer is carried out by the transfer unit 54. The registration roller 63 also corrects the skew of the printing medium P.

The feeding belt 64 sends the printing medium P separated from the photoconductive drum 50 into the fixing unit 58.

The paper eject roller 65 ejects the printing medium P passed through the fixing unit 58 to outside of the casing 1.

The paper eject tray 66 is attached outside of the casing 1. On the paper eject tray 66, the printing medium P ejected by the paper eject roller 65 is placed.

An optional unit such as a finisher can be attached to the feeding unit 6.

Figure 2:
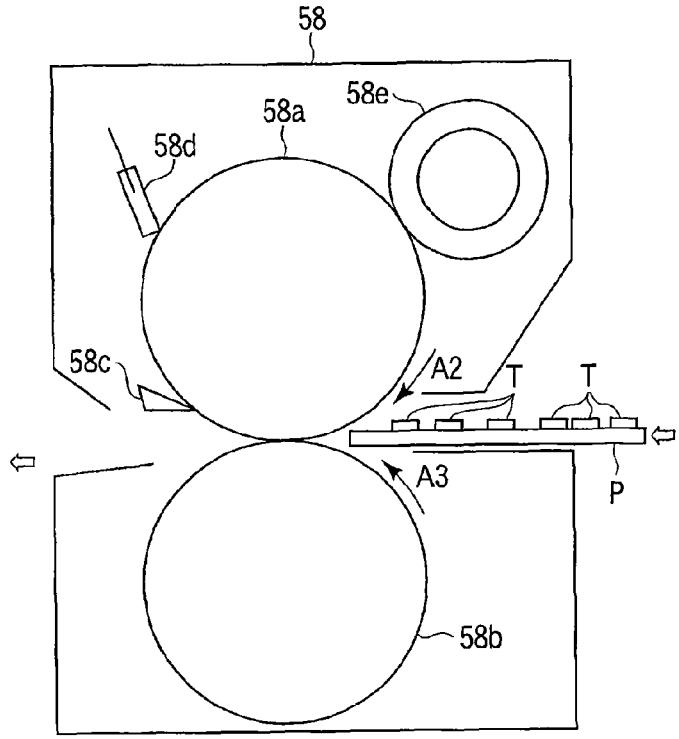
FIG. 2 shows the specific configuration of a fixing unit shown in FIG. 1.

FIG. 2 shows the specific configuration of the fixing unit 58.

The fixing unit 58 includes a heating roller 58*a*, a pressurizing roller 58*b*, a separation pawl 58*c*, a cleaning member 58*d*, and a coating roller 58*e*.

The heating roller 58*a* has a built-in heat source such as halogen lamp. The pressurizing roller 58*b* is arranged substantially parallel to the heating roller 58*a* and is brought into contact with the heating roller 58*a* in a pressurized state by a pressurizing mechanism, not shown. The heating roller 58*a* is supported rotatably about its axis as the rotation axis and is rotated in the direction indicated by arrow A2 by a rotation mechanism, not shown. The pressurizing roller 58*b* is supported rotatably about its axis as the rotation axis and rotates in the direction indicated by arrow A3, following the rotation of the heating roller 58*a*. The printing medium P sent in by the feeding belt 64 is inserted between the heating roller 58*a* and the pressurizing roller 58*b*. Then, the fixing unit 58 melts and fixes a toner T electrostatically adhering to the printing medium P, with the heat generation by the heating roller 58*a* and the pressurization by the heating roller 58*a* and the pressurizing roller 58*b*.

The separation pawl 58*c* separates the printing medium P from the heating roller 58*a*.

The cleaning member 58*d* removes the toner and paper particles adhering to the heating roller 58*a*.

The coating roller 58*e* is arranged substantially parallel to the heating roller 58*a* and in contact with the heating roller 58*a*. The coating roller 58*e* coats the surface of the heating roller 58*a* with a release agent.

Figure 3:
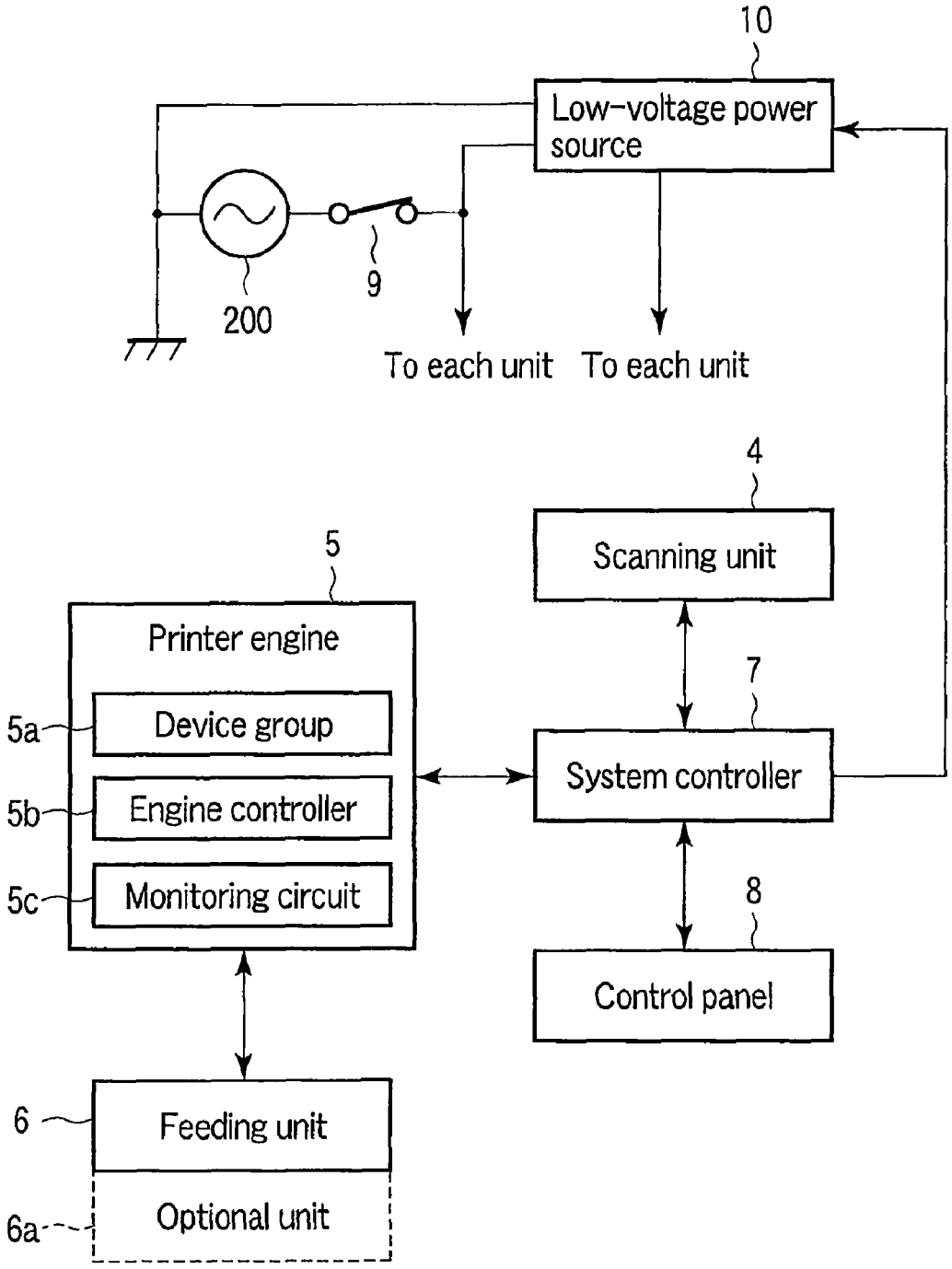
FIG. 3 is a block diagram showing the electric configuration of the MFP shown in FIG. 1.

FIG. 3 is a block diagram showing the electric configuration of the MFP 100. In FIG. 3, the same parts as in FIG. 1 and FIG. 2 are denoted by the same reference numerals.

The MFP 100 includes a system controller 7, a control panel 8, a main switch 9 and a low-voltage power source 10, in addition to the scanning unit 4, the printer engine 5 and the feeding unit 6. The scanning unit 4, the printer engine 5, the control panel 8 and the low-voltage power source 10 are connected to the system controller 7. The feeding unit 6 is connected to the printer engine 5. To connect the system controller 7 with the scanning unit 4 and the printer engine 5, for example, a universal asynchronous receiver transmitter (UART) is used. To connect the system controller 7 with the control panel 8 and the low-voltage power source 10 and to connect the printer engine 5 with the feeding unit 6, for example, a control line is used.

The scanning unit 4 includes electric components such as the exposure lamp 41, the CCD 46, a motor and sensor included in the moving mechanism which reciprocates the carriage 40, a sensor for the original placed on the original table 2, and a control circuit to control the scanning operation.

The printer engine 5 includes a device group 5*a*, an engine controller 5*b* and a monitoring circuit 5*c*.

The feeding unit 6 includes electric components such as a sensor to detect the printing medium P housed in the cassette 60, a motor and sensor included in a mechanism to operate each element, and a control circuit to control the feeding operation. In the state where an optional unit 6*a* is attached, electric components included in this optional unit 6*a* are included in the feeding unit 6.

The system controller 7 includes a CPU and peripheral devices such as ROM, RAM and interface circuit. The system controller 7 comprehensively controls the operation of the scanning unit 4, the printer engine 5 and the feeding unit 6 and thereby realizes the operation as a scanner, printer or copier.

The control panel 8 includes an input device and a display device. The input device includes, for example, a touch panel and key switches, and inputs various instructions from the user to the system controller 7. The display device includes, for example, a liquid crystal display device and displays various kinds of information that should be presented to the user, under the control of the system controller 7.

The main switch 9 switches whether or not to supply power from a commercial power source 200 to electric components that operate with this power and to the low-voltage power source 10. The main switch 9 is operated by the user.

The low-voltage power source 10 generates power of lower voltage (for example, 24 V and 5 V) than the power from the commercial power source 200. The power generated by the low-voltage power source 10 is supplied to each unit that operates with this power.

Figure 4:
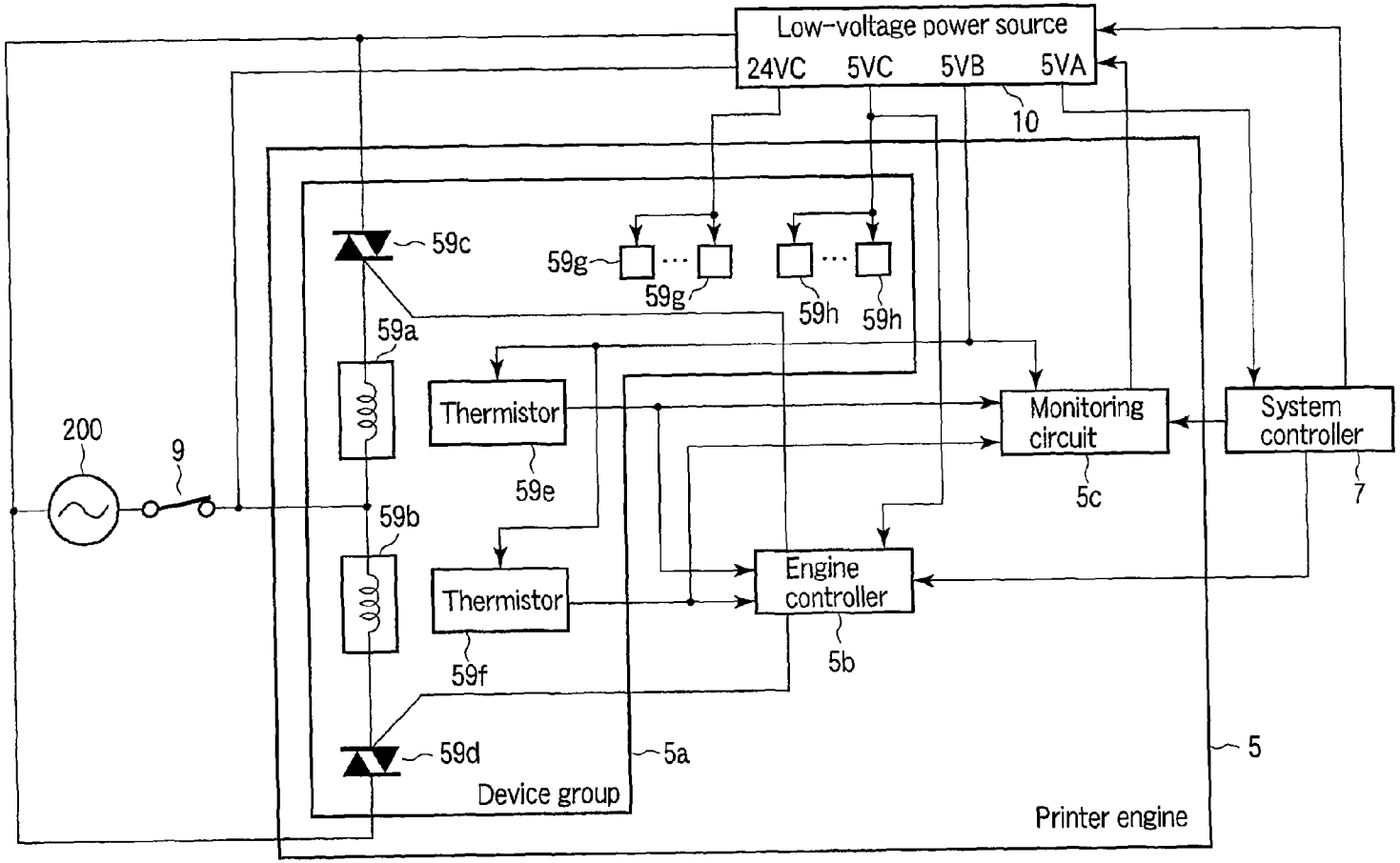
FIG. 4 shows details of a part of the electric configuration of a printer engine shown in FIG. 2 and FIG. 3.

FIG. 4 shows details of a part of the electric configuration of the printer engine 5. In FIG. 4, the same parts as in FIG. 3 are denoted by the same reference numerals.

The device group 5*a* includes fixing lamps 59*a* and 59*b*, triacs 59*c* and 59*d*, thermistors 59*e* and 59*f*, plural electric devices 59*g*, and plural electric devices 59*h*.

The fixing lamps 59*a* and 59*b* are arranged within the heating roller 58*a*. By being electrified, the fixing lamps 59*a* and 59*b* generate heat and heat the heating roller 58*a*. The fixing lamp 59*a* heats a central part of the heating roller 58*a*. The fixing lamp 59*b* heats an edge part of the heating roller 58*a*. Power supplied from the commercial power source 200 is applied to the fixing lamp 59*a* via the main switch 9 and the triac 59*c* and to the fixing lamp 59*b* via the main switch 9 and the triac 59*d*. However, power supplied from the commercial power source 200 may be processed such as being transformed and then applied to the fixing lamps 59*a* and 59*b*.

The triacs 59*c* and 59*d* are separately driven by the engine controller 5*b* and turn on and off the power supply to the fixing lamps 59*a* and 59*b*.

The thermistor 59*e* is arranged near the central part of the heating roller 58*a*. The thermistor 59*f* is arranged near the edge part of the heating roller 58*a*. The resistance values of the thermistors 59*e* and 59*f* separately change depending on the temperatures near the central part and the edge part of the heating roller 58*a*.

The electric devices 59*g* and 59*h* are various devices other than the fixing lamps 59*a* and 59*b*, the triacs 59*c* and 59*d* and the thermistors 59*e* and 59*f* included in the printer engine 5. The electric devices 59*g* and 59*h* include various devices such as motor, sensor, discharger, and ventilation fan. Although not shown, the operation of the electric devices 59*g* and 59*h* is partly controlled by the engine controller 5*b*.

The engine controller 5*b* includes a CPU and peripheral devices such as ROM, RAM and interface circuit. The engine controller 5*b* controls the operation of the device group 5*a* under the control of the system controller 7. For example, the engine controller 5*b* monitors the temperatures near the central part and the edge part of the heating roller 58*a* (hereinafter referred to as center temperature and side temperature) on the basis of the resistance values of the thermistors 59*e* and 59*f*. The engine controller 5*b* controls the triacs 59*c* and 59*d* so that the center temperature and the side temperature approach a target temperature corresponding to an operation mode set by the system controller 7.

The monitoring circuit 5*c* operates when the monitoring circuit 5*c* is validated by the system controller 7. The monitoring circuit 5*c* monitors the center temperature on the basis of the resistance value of the thermistor 59*e*. The monitoring circuit 5*c* then controls the operation of the low-voltage power source 10 on the basis of the center temperature.

The fixing lamps 59*a* and 59*b* operate with power from the commercial power source. Each of the thermistors 59*e* and 59*f*, the electric devices 59*h*, the engine controller 5*b* and the monitoring circuit 5*c* operates with power of 5V supplied from the low-voltage power source 10. Each of the electric devices 59*g* operates with power of 24 V supplied from the low-voltage power source 10.

Figure 5:
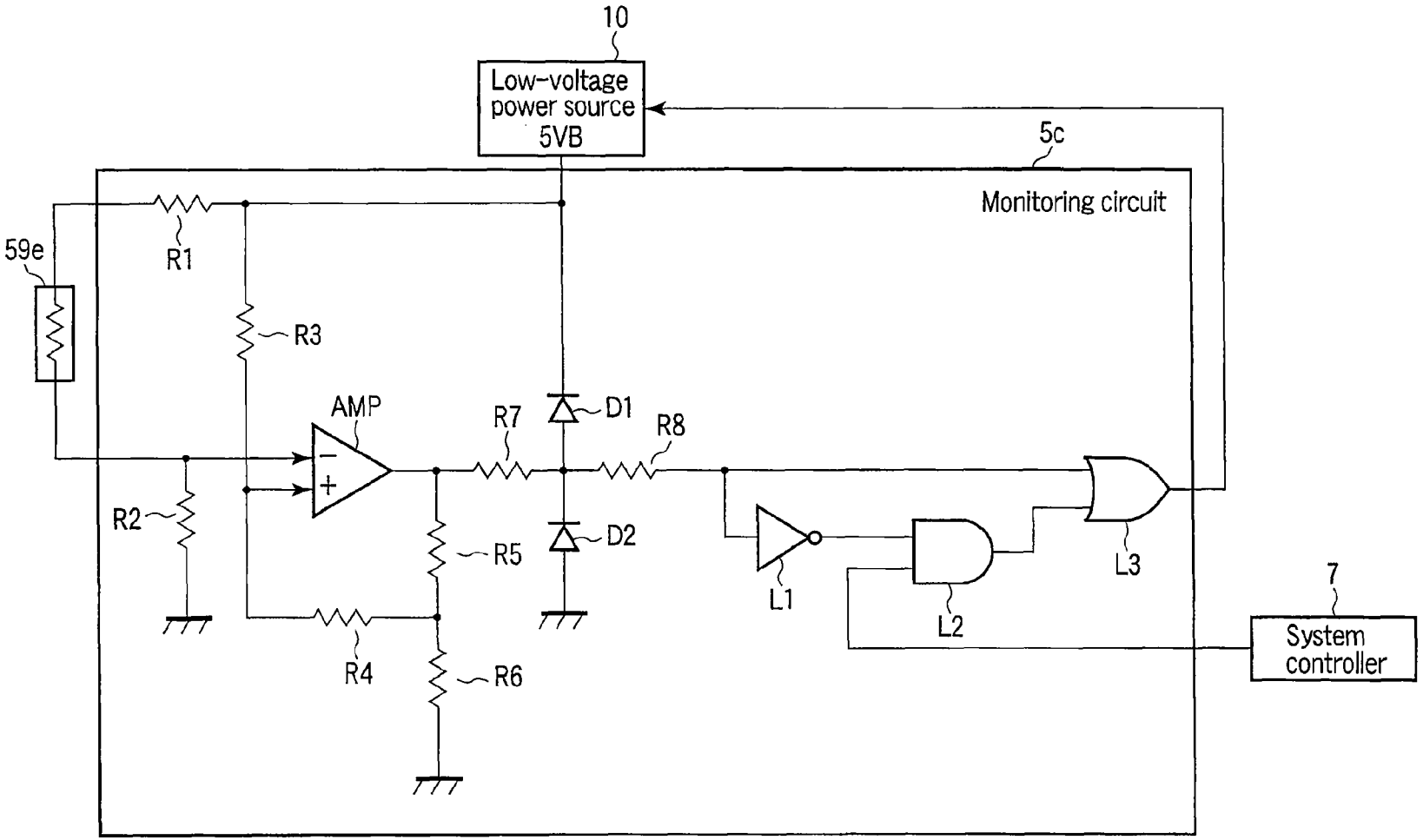
FIG. 5 is a circuit diagram showing the detailed configuration of a monitoring circuit shown in FIG. 3 and FIG. 4.

FIG. 5 is a circuit diagram showing the detailed configuration of the monitoring circuit 5*c*. In FIG. 5, the same parts as in FIG. 3 and FIG. 4 are denoted by the same reference numerals.

The monitoring circuit 5*c* includes resistors R1, R2, R3, R4, R5, R6, R7 and R8, an operational amplifier AMP, diodes D1 and D2, and logic circuits L1, L2 and L3.

The resistor R1 has its two ends connected to a terminal 5VB of the low-voltage power source 10 and to a first end of the thermistor 59*e*, respectively. The resistor R2 has its one end connected to a second end of the thermistor 59*e* and the inverting input terminal of the operational amplifier AMP and has its other end grounded. The resistor R3 has its two ends connected to the terminal 5VB of the low-voltage power source 10 and to the non-inverting input terminal of the operational amplifier AMP, respectively. The resistor R4 has its one end connected to the non-inverting input terminal of the operational amplifier AMP and has its other end connected to the resistor R5 and the resistor R6. The resistor R5 has its one end connected to the output terminal of the operational amplifier AMP and has its other end connected to the resistor R4 and the resistor R6. The resistor R6 has its one end connected to the resistor R4 and the resistor R5 and has its other end grounded. The resistor R7 has its one end connected to the output terminal of the operational amplifier AMP and has its other end connected to the resistor R8, the anode of the diode D1 and the cathode of the diode D2. The resistor R8 has its one end connected to the resistor R7, the anode of the diode D1 and the cathode of the diode D2 and has its other end connected to the input terminal of the logic circuit L1 and a first input terminal of the logic circuit L3.

The operational amplifier AMP has its inverting input terminal connected with a second end of the thermistor 59*e* and the resistor R2, has its non-inverting input terminal connected with the resistor R3 and the resistor R4, and has its output terminal connected with the resistor R5 and the resistor R7. The operational amplifier AMP has a hysteresis property prescribed by the output voltage from the terminal 5VB of the low-voltage power source 10 and the resistors R3, R4, R5 and R6. The operational amplifier AMP outputs a low-level or high-level voltage from the output terminal in accordance with the hysteresis property and the voltage applied to the inverting input terminal. The low-level or high-level voltage outputted from the operational amplifier AMP is decided depending on a voltage, not shown, supplied to the operational amplifier AMP for its operation.

The diode D1 has its anode connected with the resistor R7, the resistor R8 and the cathode of the diode D2 and has its cathode connected with the terminal 5VB of the low-voltage power source 10. The diode D2 has its cathode connected with the resistor R7, the resistor R8 and the anode of the diode D1 and has its anode grounded.

The logic circuit L1 has its input terminal connected with the resistor R8 and has its output terminal connected with a first input terminal of the logic circuit L2. If the voltage generated at the one end of the resistor R8 is equivalent to high-level, the logic circuit L1 outputs a voltage prescribed as low-level from the output terminal. If the voltage generated at the one of the resistor R8 is equivalent to low-level, the logic circuit L1 outputs a voltage prescribed as high-level from the output terminal. The logic circuit L2 has its first input terminal connected with the output terminal of the logic circuit L1, has a preheat mode signal outputted from the system controller 7 inputted to its second input terminal, and has its output terminal connected with a second input terminal of the logic circuit L3. If both the output from the output terminal of the logic circuit L1 and the preheat mode signal are of high-level, the logic circuit L2 outputs a voltage prescribed as high-level from the output terminal. Otherwise, the logic circuit L2 outputs a voltage prescribed as low-level from the output terminal. The logic circuit L3 has its first input terminal connected with the resistor R8, has its second input terminal connected with the output terminal of the logic circuit L2, and has its output terminal connected with the low-voltage power source 10. If both the voltage generated at the one end of the resistor R8 and the voltage outputted from the output terminal of the logic circuit L2 are of low-level, the logic circuit L3 outputs a voltage prescribed as low-level from the output terminal. Otherwise, the logic circuit L3 outputs a voltage prescribed as high-level from the output terminal.

Figure 6:
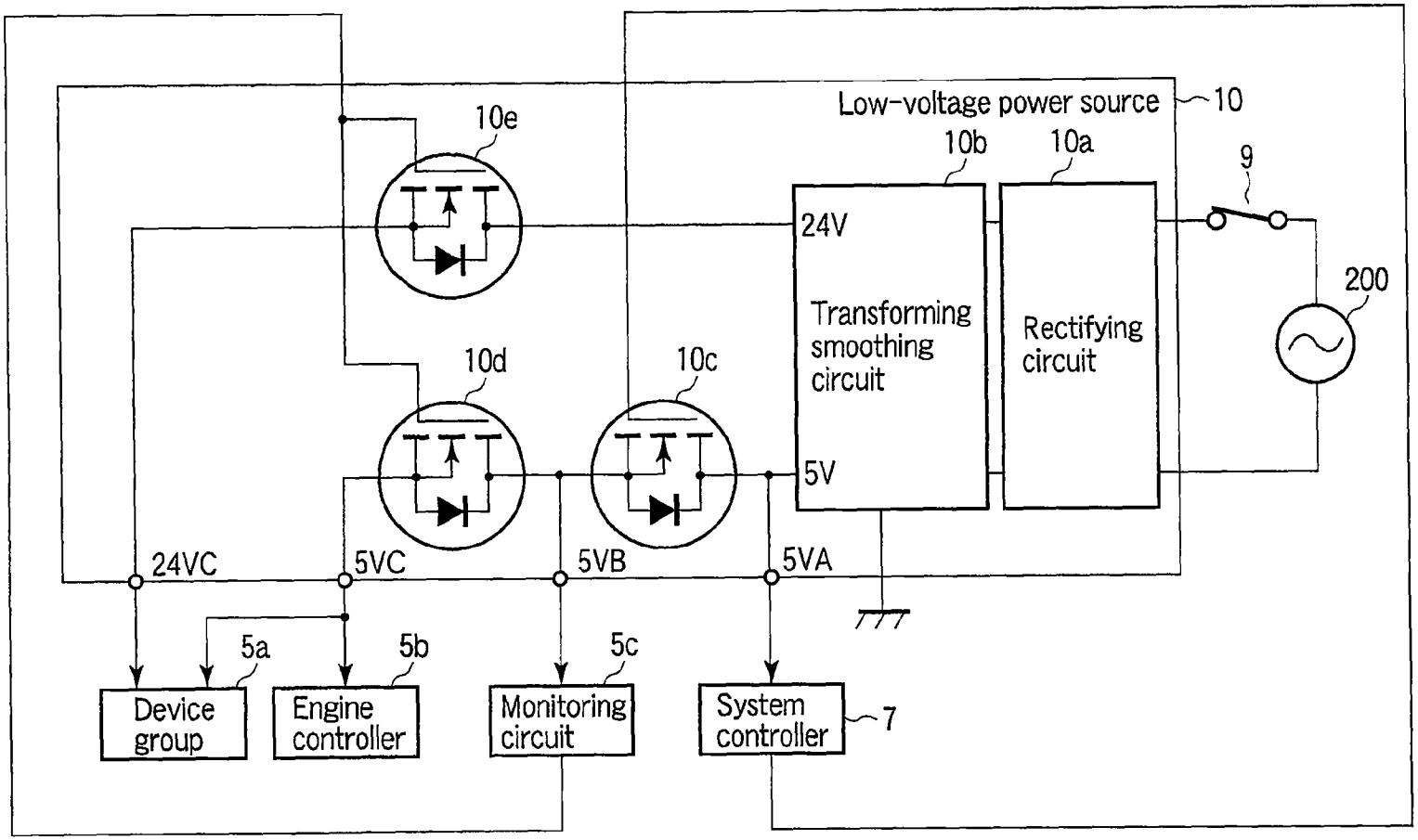
FIG. 6 shows the detailed configuration of a low-voltage power source shown in FIG. 3, FIG. 4 and FIG. 5.

FIG. 6 shows the detailed configuration of the low-voltage power source 10. In FIG. 6, the same parts as in FIG. 3 and FIG. 4 are denoted by the same reference numerals.

The low-voltage power source 10 includes a rectifying circuit 10*a*, a transforming smoothing circuit 10*b*, and switches 10*c*, 10*d* and 10*e*.

The rectifying circuit 10*a* rectifies AC power supplied from the commercial power source 200 and thus acquires DC power. The transforming smoothing circuit 10*b* transforms and smoothes the DC power acquired by the rectifying circuit 10*a* and thus acquires DC power of 5 V and 24 V with little voltage fluctuation. The DC power of 5V acquired by the transforming smoothing circuit 10*b* is outputted directly from a terminal 5VA and supplied to the system controller 7.

The switch 10*c* is turned on and off by a sleep mode signal from the system controller 7. The switch 10*c* in on-state passes the DC power of 5 V acquired by the transforming smoothing circuit 10*b*. The DC power passed through the switch 10*c* is supplied from the terminal 5VB to the thermistors 59*e* and 59*f* and the monitoring circuit 5*c*. The switch 10*d* is turned on and off by an output signal from the output terminal of the logic circuit L3 of the monitoring circuit 5*c*. The switch 10*d* in on-state passes the DC power if the DC power is passed through the switch 10*c*. The DC power passed through the switch 10*d* is outputted form a terminal 5VC and supplied to the device group 5*a* and the engine controller 5*b*. The switch 10*e* is turned on and off by an output signal from the output terminal of the logic circuit L3 of the monitoring circuit 5*c*. The switch 10*e* in on-state passes the DC power of 24 V acquired by the transforming smoothing circuit 10*b*. The DC power passed through the switch 10*e* is outputted from a terminal 24VC and supplied to the device group 5*a*.

Next, the operation of the MFP 100 will be described.

The MFP 100 can execute scanning, printing and copying operations and the like. However, these operations are similar to those of a conventional MFP and therefore will not be described further in detail. A characteristic operation in the MFP 100 is an operation to reduce power consumption in the printer engine 5. Thus, hereinafter, this characteristic operation will be described in detail.

Figure 7:
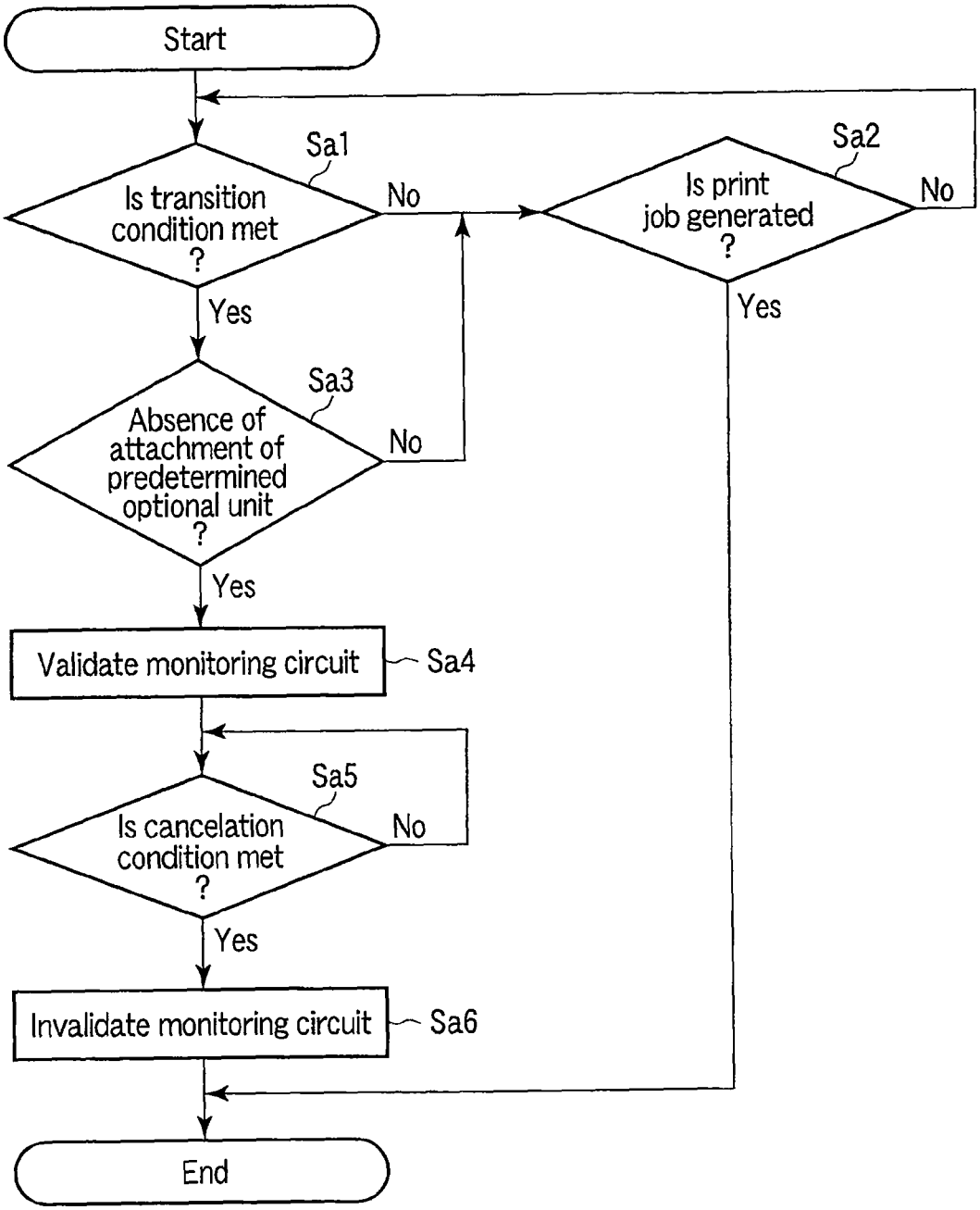
FIG. 7 is a flowchart for a system controller shown in FIG. 3, FIG. 4, FIG. 5 and FIG. 6.

If a print job that is being executed becomes complete, the system controller 7 starts the processing shown in FIG. 7.

At this time, a preheat mode is not set, which will be described later. When the preheat mode is not set, the system controller 7 maintains the preheat mode signal at high-level, for example, as in a period P1 shown in FIG. 8. In this case, in the monitoring circuit 5*c*, the logic circuit L2 directly passes the output signal of the logic circuit L1. In this state, low-level and high-level signals are constantly inputted to the first and second input terminals of the logic circuit L3, respectively, or to the second and first input terminals, respectively. Therefore, the output signal of the logic circuit L3 is fixed at high-level. Consequently, in the low-voltage power source 10, both the switches 10*d* and 10*e* are fixed to on-state and DC power of 24 V is continuously supplied to the device group 5*a*. If the system controller 7 does not set the sleep mode, either, and the sleep mode signal is at high-level, DC power of 5 V is continuously supplied to the device group 5*a* and the engine controller 5*b*.

Thus, if neither the preheat mode nor the sleep mode is set, the device group 5*a* and the engine controller 5*b* operate with the DC power supplied from the low-voltage power source 10. In this case, the engine controller 5*b* determines the center temperature and the side temperature on the basis of the resistance values of the thermistors 59*e* and 59*f* and controls the triacs 59*c* and 59*d* so that the center temperature and the side temperature approach a predetermined target temperature Tr for standby.

In the above state, the monitoring circuit 5*c* does not fulfill any valid function. The monitoring circuit 5*c* is invalidated.

In ACT Sa1 and ACT Sat, the system controller 7 waits until a condition for transition to the preheat mode is met or a new print job is generated. Then, if a new print job is generated, the system controller 7 ends the processing shown in FIG. 7 and shifts to processing to execute the print job.

The condition for transition to the preheat mode is, for example, that the elapsed time after the completion of a print job exceeds a prescribed time, that transition to the preheat mode is requested by the user, and so on. It is also possible to use only one of these conditions as the above condition for transition, or to use plural conditions as the above condition for transition. The condition used as the condition for transition may be changed in accordance with an instruction from the user. Specifically, for example, only the latter condition is used as the condition for transition in default setting, whereas the former condition is validated as the condition for transition as well in accordance with an instruction from the user.

If the condition for transition is met, the system controller 7 goes from ACT Sa1 to ACT Sa3. In ACT Sa3, the system controller 7 confirms whether a predetermined unit is attached as the optional unit 6*a* or not. The predetermined unit is a unit which takes a long time to restore operation from the state where power supply is shut down. A typical example of predetermined unit is a finisher. If plural kinds of units exist as the optional unit 6*a*, which of these units should be used as the predetermined unit can be arbitrarily determined and typically decided by the designer of the MFP 100. However, if the system controller 7 sets which of the plural kinds of units should be used as the predetermined unit in accordance with an instruction from the user, operation corresponding to the user's needs is possible, which is more convenient.

If the predetermined unit is attached as the optional unit 6*a*, the system controller 7 returns to the waiting state of ACT Sa1 and ACT Sa2 from ACT Sa3. That is, in this case, the system controller 7 does not set the preheat mode, which will be described later. This processing of ACT Sa3 may be omitted and the preheat mode may be set irrespective of the attachment state of the optional unit 6*a*.

If the predetermined unit is not attached as the optional unit 6*a*, the system controller 7 goes from ACT Sa3 to ACT Sa4. In ACT Sa4, the system controller 7 validates the monitoring circuit 5*c*. Specifically, the system controller 7 sets the preheat mode signal at low-level, as can be seen at a time point T1 in FIG. 8. Thus, the output of the logic circuit L2, that is, the input to the second input terminal of the logic circuit L3, is fixed at low-level. Therefore, the input level at the first input terminal of the logic circuit L3 is directly outputted from the output terminal of the logic circuit L3.

In the monitoring circuit 5*c*, a detected voltage Vdet corresponding to the resistance value of the thermistor 59*e* is inputted to the inverting terminal of the operational amplifier AMP by the thermistor 59*e*, the resistor R1 and the resistor R2. A reference voltage Vref generated by the resistors R3, R4, R5 and R6 is inputted to the non-inverting input terminal of the operational amplifier AMP. Since the output voltage of the operational amplifier AMP is fed back by the resistor R5, the reference voltage Vref takes different values from each other Vhigh and Vlow for positive and negative output voltages from the operational amplifier AMP, respectively. The voltage Vhigh is larger than the voltage Vlow. The resistance values of the resistors R1, R2, R3, R4, R5 and R6 are properly set so that the detected voltage Vdet when the detected temperature at the thermistor 59*e* is a temperature Thigh is equal to the voltage Vhigh, whereas the detected voltage Vdet when the detected temperature at the thermistor 59*e* is a temperature Tlow is equal to the voltage Vlow. However, the temperature Thigh is the upper limit temperature for the preheat mode and the temperature Tlow is the lower limit temperature for the preheat mode. The relation of Tr>Thigh>Tlow holds. The voltages Vhigh and Vlow may be fixed at default values or may have values that are designated by the user.

When transition to the preheat mode is made, the detected temperature at the thermistor 59*e* is close to the target temperature Tr. Therefore, the detected voltage Vdet is always greater than the reference voltage Vref and the output voltage of the operational amplifier AMP is negative. In this case, the resistors R7 and R8 and the diodes D1 and D2 input a low-level to the first input terminal of the logic circuit L3. Since the logic circuit L3 directly outputs the input level at the first input terminal, as described above, the output from the output terminal of the logic circuit L3 is of low-level, too. If the output from the output terminal of the logic circuit L3 is of low-level, both the switches 10*d* and 10*e* in the low-voltage power source 10 are turned off and power supply stops. Thus, the operation of the device group 5*a* and the engine controller 5*b* stops.

Figure 8:
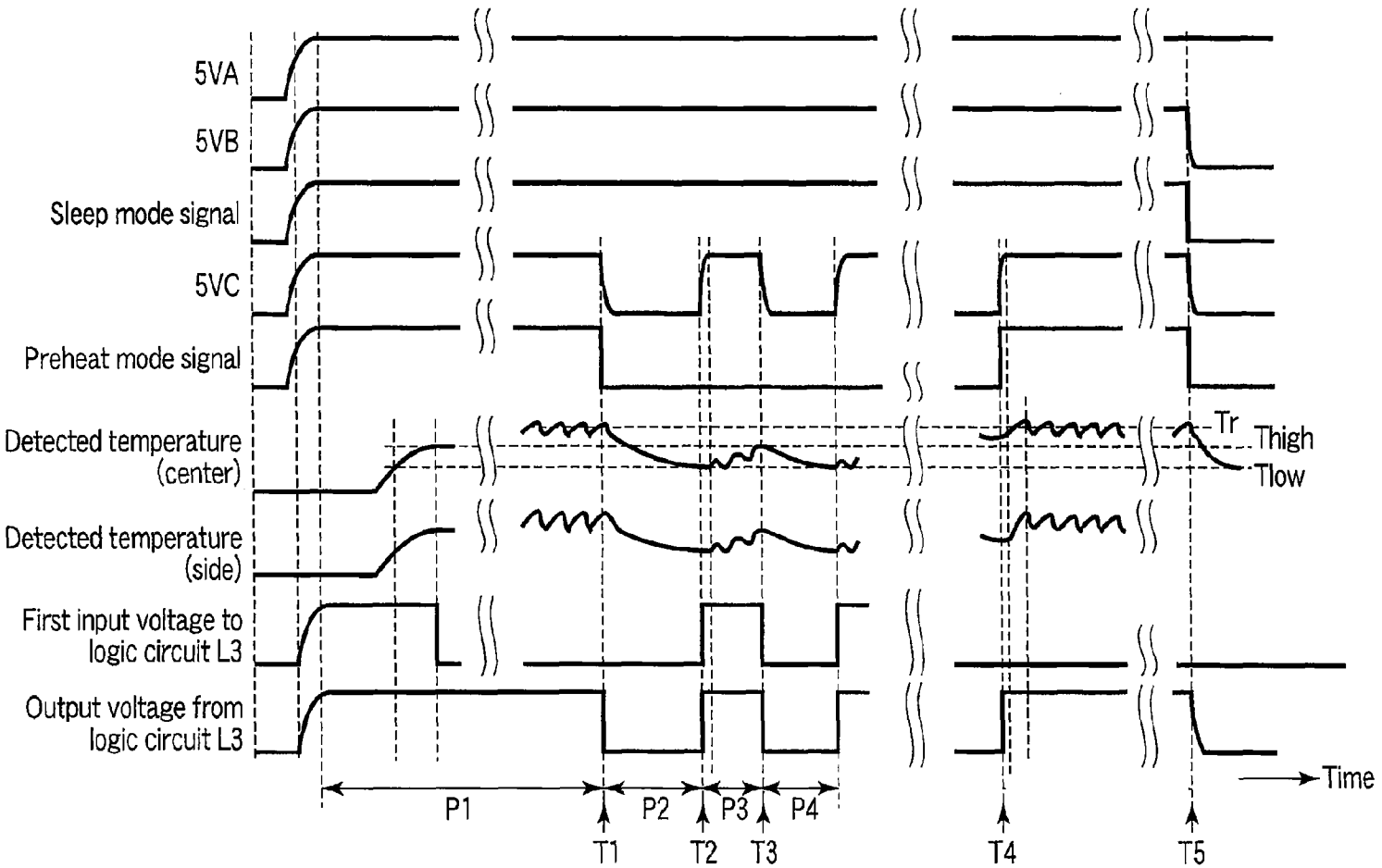
FIG. 8 is a timing chart in an exemplary operation of the MFP shown in FIG. 1.

In the state where the operation of the device group 5*a* and the engine controller 5*b* is stopped, the fixing lamps 59*a* and 59*b* do not generate heat and the temperature of the fixing roller 58*a* gradually falls, for example, as can be seen in a period P2 in FIG. 8. During such period, since the output voltage of the operational amplifier AMP is negative, the reference voltage Vref is equal to the voltage Vlow. Therefore, if the detected temperature Tdet falls to the lower limit temperature Tlow, the detected voltage Vdet becomes smaller than the reference voltage Vref and the output voltage of the operational amplifier AMP becomes positive. When the output voltage of the operational amplifier AMP is positive, the resistors R7 and R8 and the diodes D1 and D2 input a high-level to the first input terminal of the logic circuit L3. Since the logic circuit L3 directly outputs the input level at the first input terminal, as described above, the output from the output terminal of the logic circuit L3 is of high-level, too. Thus, in accordance with the fall of the detected temperature Tdet to the lower limit temperature Tlow, the output level of the logic circuit L3 changes from low-level to high-level, as can been at a time point T2 in FIG. 8. Accordingly, the operation of the device group 5*a* and the engine controller 5*b* is resumed and heating of the fixing roller 58*a* is resumed. Thus, the temperature of the fixing roller 58*a* gradually rises, as can be seen in a period P3 in FIG. 8.

The engine controller 5*b* controls the triacs 59*c* and 59*d* so that the temperature of the fixing roller 58*a* approaches the target temperature Tr. However, during such period, since the output voltage of the operational amplifier AMP is positive, the reference voltage Vref is equal to the voltage Vhigh. Therefore, if the detected temperature Tdet rises to the upper limit temperature Thigh, the output voltage of the operational amplifier AMP becomes negative and the output voltage of the logic circuit L3 returns to low-level, as can be seen at a time point T3 in FIG. 8. Consequently, the operation of the device group 5*a* and the engine controller 5*b* is stopped. After that, the temperature of the fixing roller 58*a* gradually falls, for example, as can be seen in a period P4 in FIG. 8.

In the state where the preheat mode is set, the operation as described above is repeated and therefore the temperature of the fixing roller 58*a* is adjusted between the lower limit temperature Tlow and the upper limit temperature Thigh. During a period when the fall of the temperature of the fixing roller 58*a* to the lower limit temperature Tlow is waited for, the operation of the device group 5*a* and the engine controller 5*b* is stopped. The reference voltage Vref is changed to the voltage Vhigh and the voltage Vlow, thus causing the on-off control of heating of the fixing roller 58*a* to have hysteresis. Therefore, the proportion of the period when the operation of the device group 5*a* and the engine controller 5*b* is stopped, in the preheat mode setting period, is improved. However, the reference voltage Vref may be fixed at one value.

In such state, the system controller 7 waits for a cancellation condition for the preheat mode to be met. The cancellation condition for the preheat mode is, for example, that a new print job is generated, that cancellation of the preheat mode is requested by the user, and the like. It is possible to use only one of these conditions as the above cancellation condition or to use plural conditions as the above cancellation condition. The condition to be used as the cancellation condition may be changed in accordance with an instruction from the user. Specifically, for example, only the latter condition is used as the cancellation condition in default setting, whereas the former condition is validated as the cancellation condition as well in accordance with an instruction from the user.

If the cancellation condition is met, the system controller 7 goes from ACT Sa5 to ACT Sa6. In ACT Sa6, the system controller 7 invalidates the monitoring circuit 5*c*. Specifically, the system controller 7 sets the preheat mode signal at high-level, for example, as can be seen at a time point T4 in FIG. 8. Thus, the output signal of the logic circuit L3 is fixed at high-level and the device group 5*a* and the engine controller 5*b* operate. The temperature of the fixing roller 58*a* is adjusted to approach the target temperature Tr.

The system controller 7 monitors whether a condition for transition to the sleep mode is met, through another processing, not shown. If the condition for transition to the sleep mode is met, the sleep mode signal is turned to low-level, as can be seen at a time point T5 in FIG. 8. Then, the switch 10*c* is turned off and the supply of DC power of 5 V to the device group 5*a*, the engine controller 5*b* and the monitoring circuit 5*c* is stopped. Thus, as the operation of the monitoring circuit 5*c* is stopped, the switch 10*e* is fixed to off-state. The supply of DC power of 24 V to the device group 5*a* is stopped as well.

In this way, while the sleep mode is set, the temperature of the fixing roller 58*a* is not controlled at all.

Figure 9:
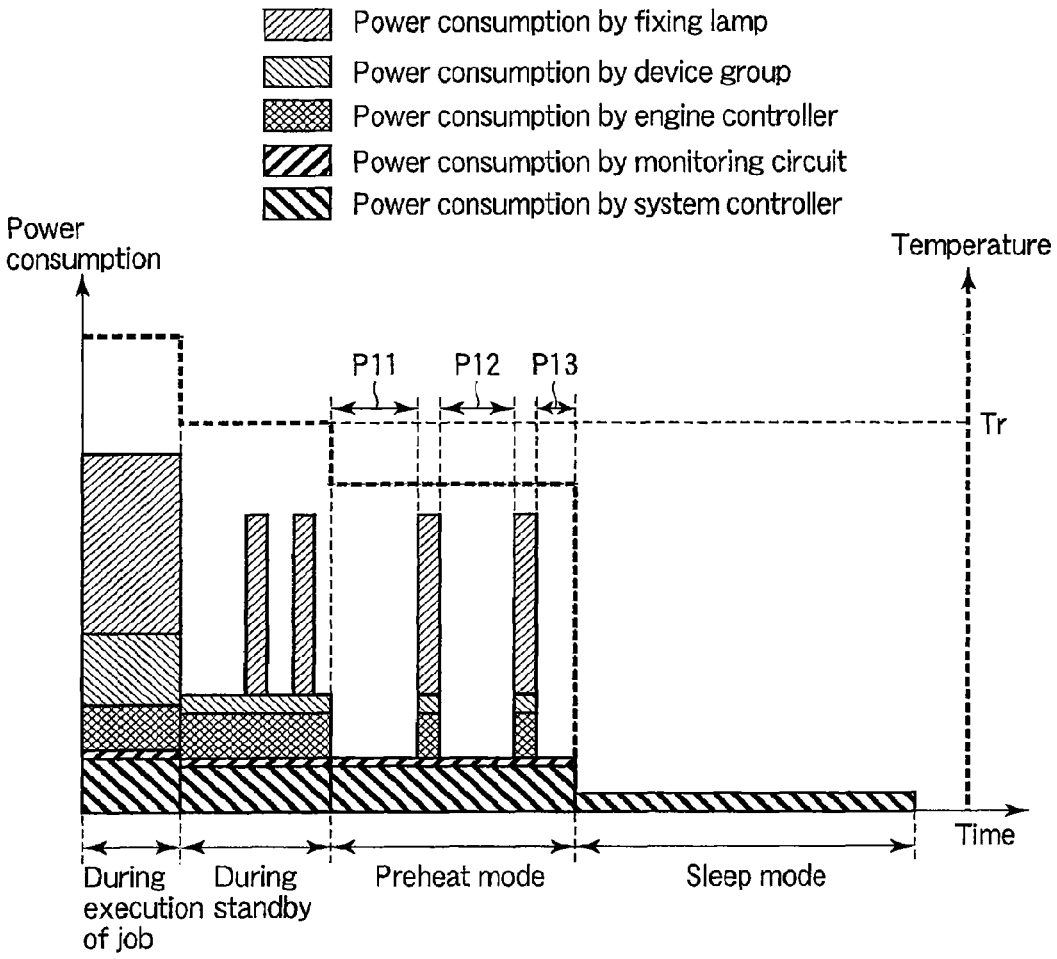
FIG. 9 shows an exemplary change in power consumption in the MFP shown in FIG. 1.
Figure 10:
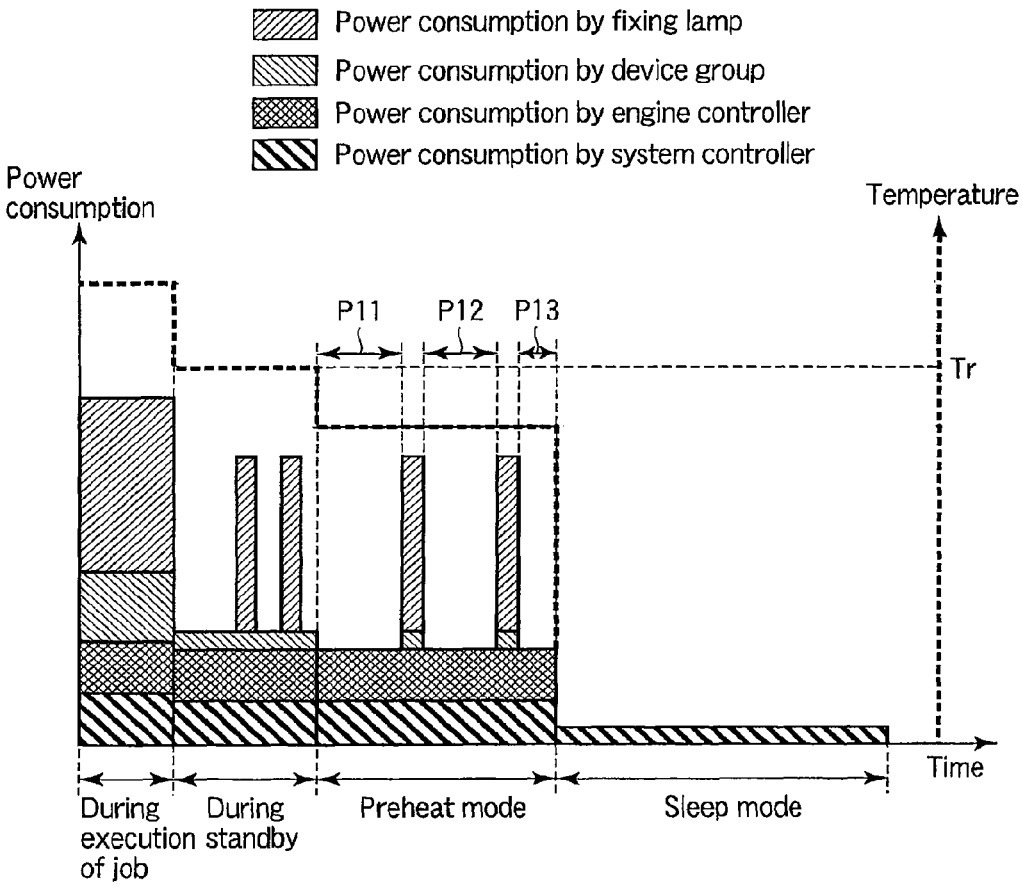
FIG. 10 shows an exemplary change in power consumption in a conventional MFP.

FIG. 9 shows an exemplary change in power consumption in the MFP 100. FIG. 10 shows an exemplary change in power consumption in a conventional MFP. FIG. 9 and FIG. 10 show how power consumption changes when similar processes are taken.

As can be seen from the comparison between FIG. 9 and FIG. 10, during periods P11, P12 and P13 where the fixing lamp need not be electrified in the preheat mode, there is power consumption by the engine controller in the conventional example, whereas there is no power consumption by the engine controller in the MFP 100. In the MFP 100, there is power consumption by the monitoring circuit 5*c*, but power consumption by the monitoring circuit 5*c* is very small. Therefore, in total, power consumption in the MFP 100 is smaller than in the conventional example.

For this embodiment, various modifications can be made as follows.

The monitoring circuit 5*c* may perform on-off control of the operation of the device group 5*a* and the engine controller 5*b* in accordance with the cumulative time of period when the detected temperature exceeds the reference temperature.

Figure 11:
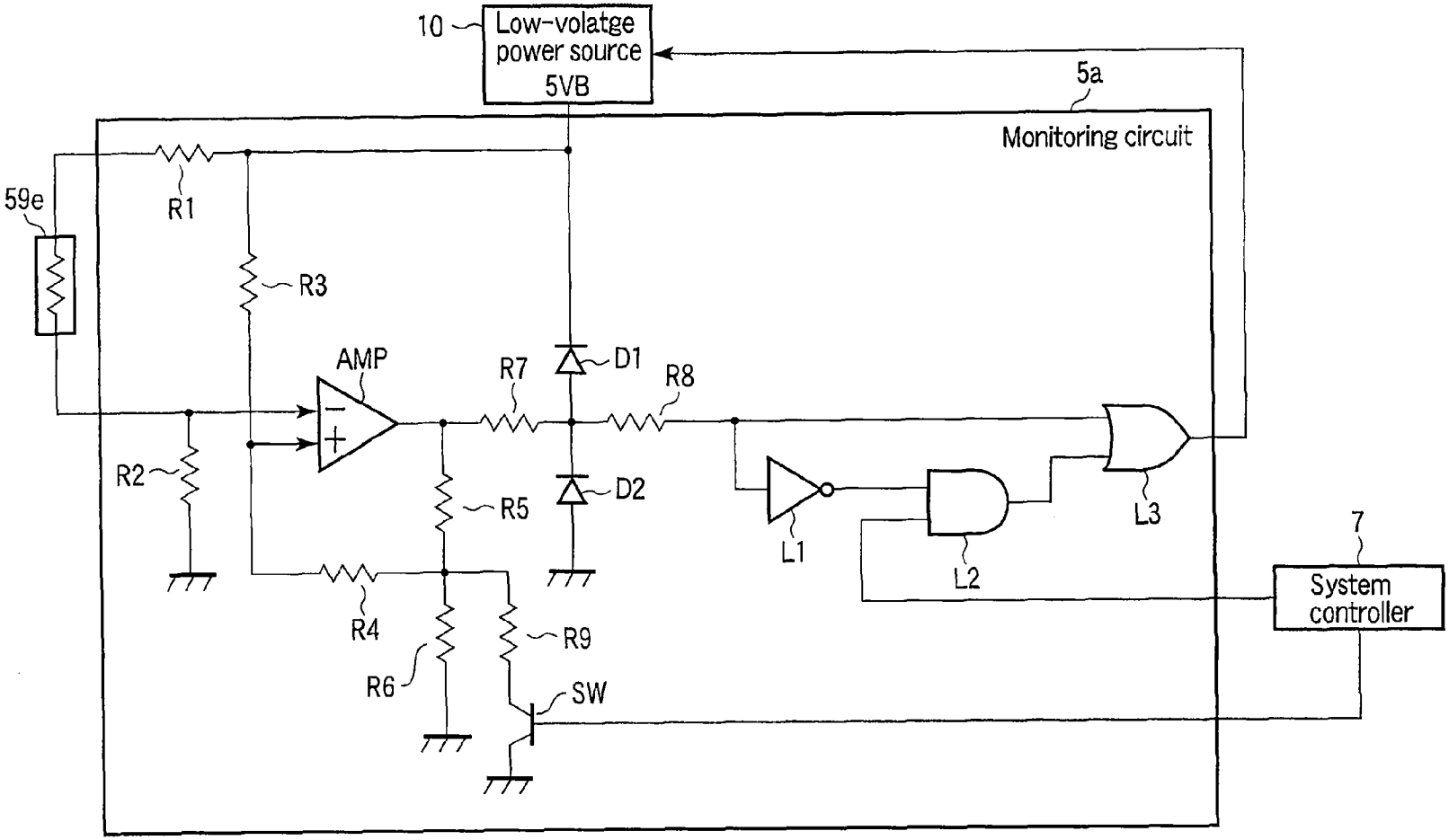
FIG. 11 is a circuit diagram showing an exemplary modified configuration of the monitoring circuit shown in FIG. 3 and FIG. 4.

The quantity of hysteresis in on-off control of heating of the fixing roller 58*a* by the monitoring circuit 5*c* may be made variable. Specifically, a serial circuit of a resistor R9 and a switching element SW is connected parallel to the resistor R6, and the switching element SW is switched by the system controller 7, for example, as shown in FIG. 11. With this configuration of FIG. 11, the quantity of hysteresis can be changed in two stages. As the switching element SW, various switching elements can be used other than the transistor as shown in FIG. 11. The switching element SW may also be automatically switched by the system controller 7 in accordance with a predetermined rule or may be switched by the system controller 7 in accordance with an instruction from the user. Also, a device that can be directly switched by the user may be used as the switching element SW, and the user may manually switch the switching element SW. Moreover, the quantity of hysteresis can be made changeable in three or more stages by connecting at least still another serial circuit of a resistor and a switching element parallel to the resistor R6.

The embodiment is not limited to an electrophotographic apparatus installed in an MFP and can be applied to an electrophotographic apparatus installed in various apparatuses such as printer apparatus or copier apparatus.

The temperature control technique in the embodiment can also be applied to temperature control of various heat generating bodies other than the fixing roller.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A temperature control apparatus comprising:

a temperature sensor which detects a temperature of a heating element;

a controller for controlling heat generation of the heating element in accordance with the detected temperature, wherein the controller controls heat generation of the heating element so that the detected temperature approaches a target temperature; and a monitoring circuit which monitors the detected temperature, and stops operation of the controller during a stop period when a predetermined operation mode is set, wherein the monitoring circuit defines, as the stop period when the predetermined operation mode is set, a period from a time point when the controller is operating and it is confirmed that the detected temperature is higher than a first reference temperature that is lower than the target temperature to a time point when the detected temperature is lower than a second reference temperature that is lower than the first reference temperature.

2. The apparatus of claim 1, wherein the monitoring circuit sets at least one of the first reference temperature and the second reference temperature in accordance with an instruction from a user.

3. The apparatus of claim 1, wherein the monitoring circuit decides the stop period in accordance with a cumulative time of a period during which the detected temperature exceeds a reference temperature.

4. An electrophotographic apparatus comprising:

an image forming unit which, after a toner image is formed on a printing medium, melts and fixes the toner image to the printing medium with heating by a heating element;

a temperature sensor which detects a temperature of a heating element;

a controller for controlling heat generation of the heating element in accordance with the detected temperature, wherein the controller controls heat generation of the heating element so that the detected temperature approaches a target temperature; and a monitoring circuit which monitors the detected temperature, and stops operation of the controller during a stop period when a predetermined operation mode is set, wherein the monitoring circuit defines, as the stop period when the predetermined operation mode is set, a period from a time point when the controller is operating and it is confirmed that the detected temperature is higher than a first reference temperature that is lower than the target temperature to a time point when the detected temperature is lower than a second reference temperature that is lower than the first reference temperature.

5. The apparatus of claim 4, wherein the monitoring circuit sets at least one of the first reference temperature and the second reference temperature in accordance with an instruction from a user.

6. The apparatus of claim 4, wherein the monitoring circuit decides the stop period in accordance with a cumulative time of a period during which the detected temperature exceeds a reference temperature.

7. The apparatus of claim 4, further comprising a control unit which set the predetermined operation mode in accordance with whether a predetermined condition is met.

8. The apparatus of claim 7, wherein the control unit supplies, to the monitoring circuit, a mode signal having a first level when the predetermined operation mode is set and having a second level otherwise, and the monitoring circuit defines, as the stop period when the mode signal has the first level, a period from a time point when the controller is operating and it is confirmed that the detected temperature is higher than a first reference temperature that is lower than a target temperature to a time point when the detected temperature sensor is lower than a second reference temperature that is lower than the first reference temperature.

9. A method for controlling temperature of a heating element comprising:

detecting a temperature of a heating element by a temperature sensor;

controlling, by a controller, heat generation of the heating element in accordance with a detected temperature, wherein the controller controls heat generation of the heating element so that the detected temperature approaches a target temperature; and monitoring the detected temperature by a monitoring circuit and stopping operation of the controller during a stop period when a predetermined operation mode is set, wherein the monitoring circuit defines, as the stop period when the predetermined operation mode is set, a period from a time point when the controller is operating and it is confirmed that the detected temperature is higher than a first reference temperature that is lower than the target temperature to a time point when the detected temperature is lower than a second reference temperature that is lower than the first reference temperature.

* * * * *